United States Patent [19]

Jimenez et al.

[11] 4,429,468

[45] Feb. 7, 1984

[54] SEE-THROUGH TYPE TELESCOPE SIGHT MOUNT FOR FIREARMS

[76] Inventors: Ivan Jimenez; Irving N. Rubin, both of 5555 Treadwell, Wayne, Mich. 48184

[21] Appl. No.: 326,635

[22] Filed: Dec. 2, 1981

[51] Int. Cl.[3] ..... F41G 1/38

[52] U.S. Cl. ..... 33/245; 33/261; 42/1 ST

[58] Field of Search ..... 33/245, 250, 246, 247, 33/233, 261, 249; 42/1 ST

[56] References Cited

U.S. PATENT DOCUMENTS

| | | | |
|---|---|---|---|
| 2,580,246 | 12/1951 | Schall | 42/1 ST |
| 2,743,526 | 5/1956 | Ivy | 42/1 ST |
| 3,611,606 | 10/1971 | Sefried et al. | 33/245 |
| 3,835,565 | 9/1974 | Weast | 42/1 ST |
| 3,875,675 | 4/1975 | Krisay | 42/1 ST |
| 4,026,055 | 6/1977 | Weast | 33/245 |

*Primary Examiner*—William D. Martin, Jr.
*Attorney, Agent, or Firm*—Stephenson & Boller

[57] ABSTRACT

A see-through type telescope sight mount for firearms comprises a pair of mounting members operatively coupled together. Each mounting member comprises a quarter circular first portion forming a portion of a receptacle for the body of a telescope sight, a second generally semioval portion below the first portion adapted to engage via its free distal edge a corresponding groove in the firearm and a third portion joining one end of the first portion to the other end of the second portion. The third portions confront each other and fasteners pass through the respective third portions to operatively couple the two mounting members. A protuberance is provided in each mounting member along the juncture of its first and third portions and two protuberances are in abutting relationship with each other to thereby space apart the respective third portions. The abutting protuberances form a fulcrum about which the fasteners are effective to set the span between the distal edges of the second portions thereby releasably clamping the mount on the firearm.

7 Claims, 4 Drawing Figures

SEE-THROUGH TYPE TELESCOPE SIGHT MOUNT FOR FIREARMS

BACKGROUND AND SUMMARY OF THE INVENTION

The present invention relates to telescope sight mount systems for firearms and is specifically concerned with a new and improved telescope sight mount including a see-through.

Telescope sight mounts are commonly used in firearms for mounting a telescope sight on the firearm. While the telescope sight provides magnification of a target, it may restrict the overall field of view. Accordingly it is often desirable to take advantage of the existing non-telescopic sights in addition to having a telescope sight. See-through type telescope mounts have been developed for this purpose, and examples are shown in U.S. Pat. Nos. 2,743,526; 3,463,430; 2,763,930; 2,580,246; and 3,875,675 among others. In general a see-through type mount comprises a receptacle for the body of the telescope which is supported in space relation to the firearm barrel so as to leave a see-through between the telescope and the firearm through which the non-telescopic sights on the firearm may be viewed. It is desirable that the see-through area be generally unobstructed so as to provide a maximum field of view for the shooter.

During certain procedures involving set-up of the telescope sight on a firearm it may be desirable to adjust the position of the sight mount axially of the firearm. Where adjustment is needed with the telescope already secured in the mount, it is important that such adjustment should not loosen the engagement of the mount with the scope. Furthermore when such adjustment is made, there should be minimum risk or separation of the mount from the firearm. It is also desirable to keep the number of component parts in a mount system to a minimum so as to simplify manufacturing, assembly, and inventory matters.

The present invention is directed to a new and improved see-through type telescope mount for firearms which possesses significant advantages over prior types of see-through telescope mounts. One advantage is that the mount of the present invention utilizes a very small number of component parts. Furthermore, many of the component parts are identical thereby minimizing tooling and inventory costs associated with fabrication of the mounts on a mass production basis. A further advantage is that from a functional standpoint the mount provides an excellent see-through capability yet it permits the mount to be adjusted axially on the firearm without loosening of the telescope on the mount and without undue risk that the mount will separate from the firearm.

The foregoing features, advantages and benefits of the invention, along with additional ones, will be seen in the ensuing description and claims which should be considered in connection with the accompanying drawings. The drawings disclose a preferred embodiment of the invention according to the best mode contemplated at the present time in carrying out the invention.

DESCRIPTION OF THE PREFERRED EMBODIMENT

Figure 1:
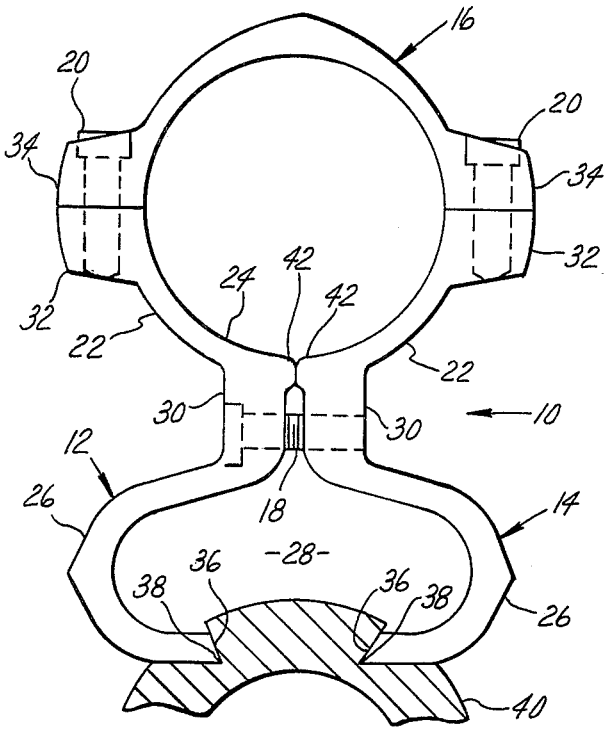
FIG. 1 is an axial view of a see-through telescope mount embodying principles of the invention, and mounted on a firearm.
Figure 3:
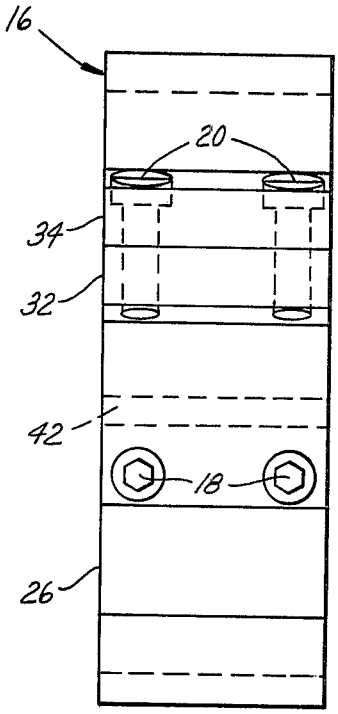
FIG. 3 is a side elevational view of the mount of FIG. 1.
Figure 2:
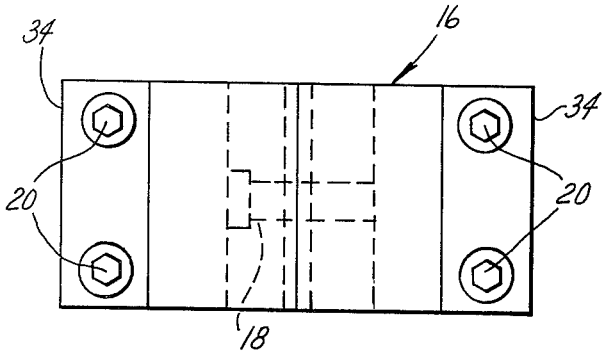
FIG. 2 is a top plan view of the mount of FIG. 1.

In the drawings an embodiment of see-through telescope sight mount 10 according to the present invention comprises a pair of mount members 12 and 14 and a clamp member 16. The two mount members 12 and 14 are symmetrically oppositely arranged and are operatively coupled by means of a pair of axially spaced screws 18. The clamp member 16 is secured at each side to the two mount members 12 and 14 by a set of screws 20.

The two mount members 12 and 14 are essentially identical. Each may be considered as comprising a first portion 22 having a generally quarter circular shape and each defining half of a semicircular receptacle 24 which receives the body of a telescope sight (not shown). Each mounting member 12 and 14 may be further considered as comprising a second portion 26 of generally semioval shape with the two second portions 26 cooperatively defining a generally oval shaped see-through 28. The members 12 and 14 may be considered as each still further comprising a third portion 30 joining the portions 22 and 26.

As viewed axially in FIG. 1 the two first portions 22 have free distal ends provided with enlargements 32. The clamp 16 has similar enlargements 34 which are disposed on the enlargements 32. The screws 20 pass through suitably counter-bored holes in the enlargements 34 and into aligned tapped holes in the underlying enlargements 32 whereby the clamp 16 is removably secured on the two mount members 12 and 14 for the purpose of clamping the body of a telescope sight in the receptacle.

The semioval second portions 26 terminate in free distal ends which are cut obliquely to form pointed edges as indicated by the reference numerals 36. The pointed edges 36 are spaced laterally apart and the distance between them constitutes a span for engaging a firearm so as to attach the mount to the firearm. In the disclosed embodiment complementary axial grooves 38 are fashioned in the top wall of the firearm 40 and are shaped so as to allow the free distal ends of the second portions 26 to clamp onto the portions of the firearm between the two grooves 38.

Figure 4:
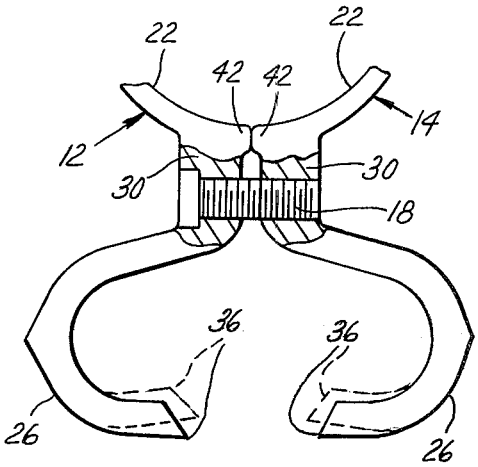
FIG. 4 is a fragmentary axial view of a portion of FIG. 1 illustrating operation.

The clamping operation is imparted to the mount by means of screws 18. The screws 18 pass through suitably counter-bored holes in the third portion 30 of one of the members, in this case the member 12, to engage tapped holes in the third portion of the opposite member, in this instance member 14. It will also be observed that each member 12 and 14 is provided with an axially extending protuberance 42 at the juncture of its corresponding first portion 22 and third portion 30. Hence the two protuberances 42 are disposed in abutment and serve to space the respective third portions 30 apart from each other in the transverse direction. As the screws 18 are tightened and loosened slightly, the abutting protuberances 42 form a fulcrum about which the free distal edges 36 of the second portions 26 can pivot. This pivotting action is demonstrated in FIG. 4 on an exaggerated scale. The screws 18 are thereby effective to set the span between the edges 36. With the clamp 16 in place clamping a telescope sight on the mount and the mount clamped onto the firearm, the actuation of screws 18 can loosen the engagement of the mount on the firearm just enough to allow the mount to be slid axially without affecting the mounting of the telescope sight in the receptacle. Once a desired axial position has been obtained, the screws 18 may be again tightened so as to tightly lock the mount in place. The tightening of the screws 18 does not impair the retention of the scope on the mount even though the clamp 16 remains fully clamped on the members 12 and 14 by screws 20.

The preferred procedure for initially mounting the telescope sight involves the two members 12, 14 being mounted on the firearm. Next the telescope is placed in the receptacle, and finally the clamp is installed.

The two members 12 and 14 may be readily fabricated by an extrusion process so that only a single extrusion die is required to impart the desired cross sectional shape. In other words the two mounts 12 and 14 are symmetrical about a vertical plane bisecting the firearm. The only differences in the two members 12 and 14 of the preferred embodiment relates to the subsequent machining of holes for the coupling screws 18. In one member the counterbored holes are provided while in the opposite member tapped holes are provided. The preferred material for the mount is extruded aluminum and this may have a metallic looking appearance or may be finished with a dark nonmetallic appearance. While the mount has been illustrated as mounting directly on the firearm, it could be mounted on a separate piece, such as a base, which is in turn attached to the firearm.

The foregoing has disclosed a new and improved see-through type telescope sight mount for a firearm. While a preferred embodiment has been disclosed, it will be appreciated that other embodiments are contemplated within the scope of the invention as set forth in the following claims.

What is claimed is:

1. In a see-through type telescope sight mount system for a firearm the combination comprising a pair of mounting members, said pair of mounting members comprising respective first portions each defining a corresponding portion of a receptacle for the body of a telescope sight, said pair of mounting members further comprising respective second portions each defining a corresponding portion of a see-through, said second portions having respective free distal ends via which the mounting members operatively mount on a firearm, said pair of mounting members still further comprising respective third portions each joining the corresponding first and second portions of its own mounting member, means joining said first portions together opposite said third portions for securely clamping the body of a telescope sight, control coupling means operatively coupling said pair of mounting members between the respective third portions for controlling the span of the free distal ends of the second portions while the telescope sight remains securely clamped, and means operatively disposed between said pair of mounting members on at least one of said first portions opposite said joining means for spacing said third portions apart and providing a fulcrum about which said control coupling means is effective to control the span of the free distal ends of the second portions by pivotal action of said second portions about said fulcrum, said control coupling means being disposed between the fulcrum and said second portions.

2. The combination set forth in claim 1 wherein said means operatively disposed between said pair of mounting members on at least one of said first portions opposite said joining means for spacing said third portions apart and providing a fulcrum about which said control coupling means is effective to control the span of the free distal ends of the second portions comprises a protuberance disposed on at least one of said mounting members.

3. The combination set forth in claim 2 wherein one of said protuberances is provided on each of said mounting members and said protuberances are in abutment with each other.

4. The combination set forth in claim 3 wherein said protuberances are disposed to extend axially of each said mounting members.

5. The combination set forth in claim 1 wherein said control coupling means comprises one or more threaded fasteners passing through corresponding apertures in one of the third portions and engaging corresponding tapped holes in the other third portion.

6. The combination set forth in claim 1 wherein said first portions are generally in the shape of quarter circles when viewed axially and wherein said joining means comprises a semicircular clamp member separably secured to the two first portions for removably clamping a telescope sight.

7. The combination set forth in claim 1 wherein each of said first portions when viewed axially has a generally quarter circular shape, each of said second portions when viewed axially has a generally semi-oval shape and each of said third portions when viewed axially comprises a straight portion connecting one of the ends of the corresponding quarter circular first portion with one end of the corresponding semi-oval second portion, said means operatively disposed between said pair of mounting members on at least one of said first portions opposite said joining means for spacing said third portions apart and providing a fulcrum about which said control coupling means is effective to control the span of the free distal ends of the second portions comprising protuberances abutting each other and disposed to extend axially of said mounting members, said coupling means comprising one or more threaded fasteners passing through corresponding apertures in one of the third portions to engage one or more corresponding tapped holes in the other third portion.

* * * * *